United States Patent [19]

Ford et al.

[11] Patent Number: 5,003,973

[45] Date of Patent: Apr. 2, 1991

[54] RESCUE HELMET APPARATUS

[76] Inventors: Theodore H. Ford; Mary A. Ford, both of 6416 Lakepoint Pl., Parker, Colo. 80134

[21] Appl. No.: 340,693

[22] Filed: Apr. 20, 1989

Related U.S. Application Data

[63] Continuation-in-part of Ser. No. 144,069, Jan. 15, 1988, abandoned.

[51] Int. Cl.[5] ..... A62B 7/02; A62B 7/08; A62B 17/04

[52] U.S. Cl. ..... 128/201.25; 2/5; 2/415; 2/422; 2/424; 128/204.18

[58] Field of Search ..... 2/5, 414, 415, 422, 2/424; 128/200.23, 201.22, 201.24, 210.25, 201.27, 204.18

[56] References Cited

U.S. PATENT DOCUMENTS

| | | | |
|---|---|---|---|
| 3,013,273 | 12/1961 | Kamperin | 2/5 |
| 3,516,404 | 6/1970 | Spross | 128/201.25 |
| 3,521,629 | 7/1970 | Reynolds | 128/201.23 |
| 3,845,768 | 11/1974 | Garrahan | 128/201.27 X |
| 3,911,914 | 10/1975 | Johansson | 2/424 X |
| 4,521,831 | 6/1985 | Thayer | 2/422 X |
| 4,549,541 | 10/1985 | Sundahl | 128/201.24 X |
| 4,729,132 | 3/1988 | Fierro | 2/414 |
| 4,787,925 | 11/1988 | Ansite | 128/201.25 X |
| 4,889,113 | 12/1989 | Pelloux-Gervais | 128/201.25 |

FOREIGN PATENT DOCUMENTS

| | | | |
|---|---|---|---|
| 2744488 | 4/1978 | Fed. Rep. of Germany | 128/201.25 |
| 2513861 | 4/1983 | France | 2/414 |
| 2595573 | 9/1987 | France | 2/424 |
| 492640 | 9/1938 | United Kingdom | 128/201.25 |
| 8601379 | 3/1986 | World Int. Prop. O. | 2/424 |
| 8605461 | 9/1986 | World Int. Prop. O. | 128/201.25 |

*Primary Examiner*—Wm. Carter Reynolds
*Attorney, Agent, or Firm*—Richard C. Litman

[57] ABSTRACT

A rescue helmet apparatus which protects the user from hazardous environments includes canisters that provide breathable air to the user. The apparatus features a helmet, reflective cape, and long-lasting lithium-powered lights in an integrated device.

5 Claims, 5 Drawing Sheets

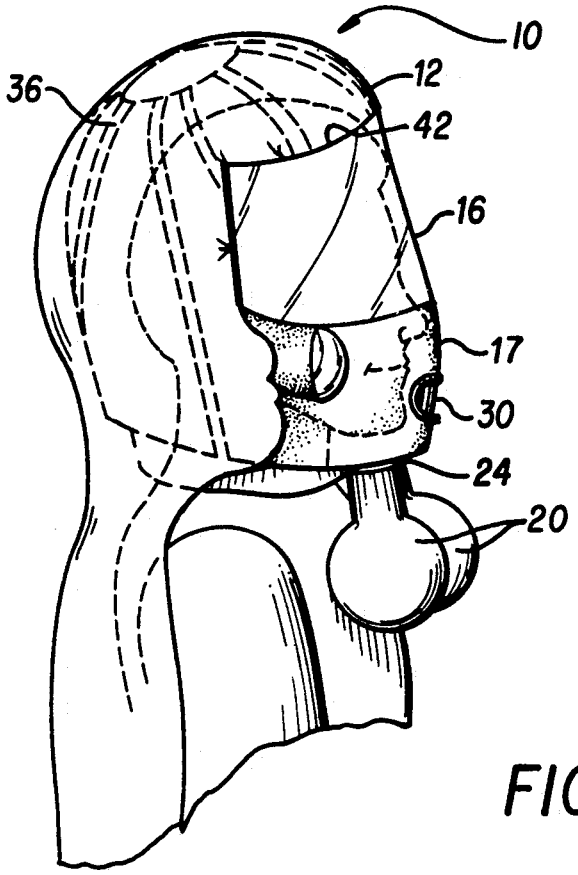
FIG. 2
FIG. 3
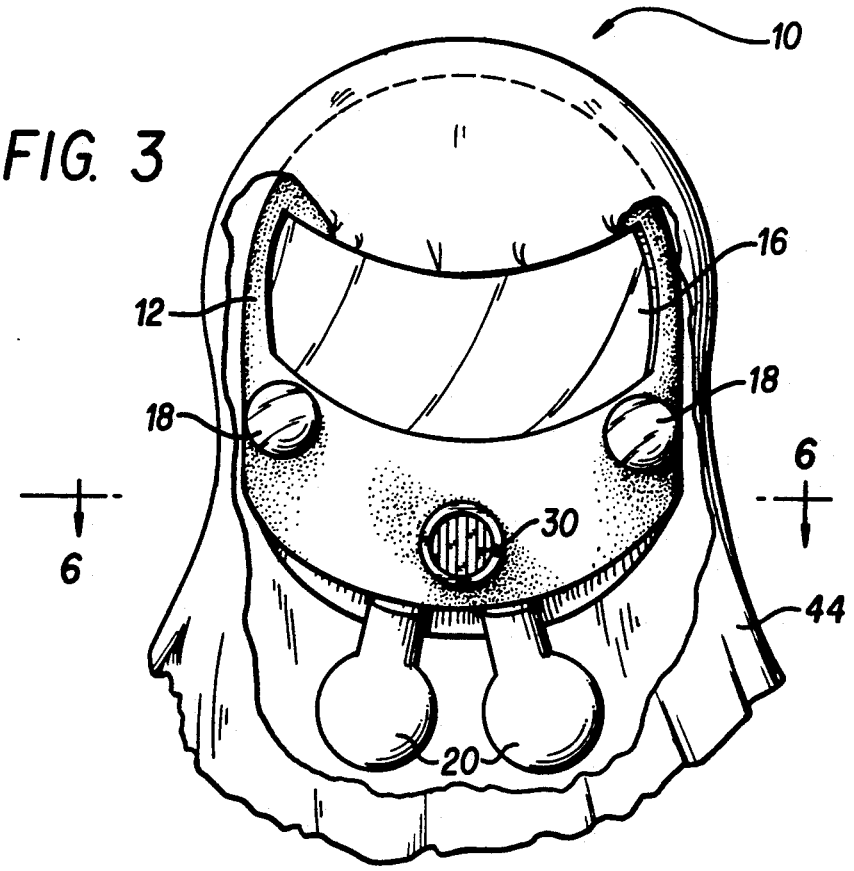

RESCUE HELMET APPARATUS

CROSS-REFERENCE TO RELATED APPLICATIONS

The present application is a continuation-in-part of the previously filed U.S. patent application Ser. No. 07/144,069 filed Jan. 15, 1988, now abandoned.

FIELD OF THE INVENTION

This invention relates to safety devices and, more particularly, to those apparatuses for the prevention of injury to firefighters, personnel in hazardous work, or others, such as household residents, who may need to escape from smoke-filled environments.

BACKGROUND OF THE INVENTION

The search for safety equipment that utilizes newer methods, features and a more proficient arrangement of the various elements thereof, is continual. The present invention incorporates means for providing breathable air, either through means for engagement to a self-contained source of air, or through means for chemically converting exhaled air into breathable air. The present invention also includes means for illumination, and a plurality of means for isolating the face of a user within a face shield airspace such as to provide a protected breathing space within the apparatus.

Further, this apparatus relates to an arrangement of the elements thereof, each having a function directed to the totality of the environmental requirements and having, concurrently, enhanced functionality as elements thereof work cooperatively to achieve the objects of the invention.

This invention relates to a molded helmet and overlying safety assembly that incorporates within itself a plurality of sub-assemblies providing for a diversity of individual element functioning while simultaneously directing each element of the apparatus, in cooperative arrangement, to the needs of individuals working within, or escaping from, smoke-filled or hostile environments, or environments that have low oxygen levels.

DESCRIPTION OF THE RELATED ART

| U.S. Pat. No. | Inventor |
|---|---|
| 4,411,023 | Pinson |
| 2,631,287 | Malcom, Jr. |
| 4,402,316 | Gadberry |

U.S. Pat. No. 4,411,023 issued to Pinson discloses a hood to protect the user from poisonous fumes and the like. This device includes a respirator with a portion to be gripped by the user's mouth.

U.S. Pat. No. 2,631,287 issued to Malcom, Jr. discloses a face protector, specifically to protect shield arrangement for the sight opening. It provides an easy applying and removal of the shield without use of tools.

U.S. Pat. No. 4,402,316 issued to Gadberry teaches a construction of a breathing gas mask constructed of an elastomeric or plastic main body, with a number of straps to hold the mask on the wearer's face. It has an oral-nasal interior breathing cover and a speaking diaphragm in adjacent relationship.

These patents or known prior art uses teach and disclose various types of protective face-wear devices of sorts and of various manufactures and the like, as well as methods of their construction; but none of them, whether taken singly or in combination, disclose the specific details of the combination of the invention in such a way as to bear upon the claims of the present invention.

SUMMARY OF THE INVENTION

An object of the present inventionis to provide a means for protecting a wearer of the apparatus from fumes, smoke and noxious gases generated as by-products of combustion. The device provides a plurality of elements allowing for flexibility in the manner of use and in the accessory items or elements that may be affixed thereto.

Another object of the device is to provide a diversity of functions such as protection from impact damage to the skull and a means for sealing an anterior portion of the device from a front-most facial portion, thereby isolating the frontal or face-shield portion from gases and smoke that may penetrate into the anterior portions of the device itself.

Another object of the device is to provide a plurality of needed, individualized functions such as illumination, and means for providing needed oxygen, within an ergonomically produced sub-assembly. The rescue helmet apparatus has the capability of providing oxygen from chemically reactive substances, or from a supply of containerized air.

These, together with other objects and advantages of the invention, reside in the details of the process and the operation thereof, as is more fully hereinafter described and claimed. References are made to drawings forming a part hereof, wherein like numerals refer to like elements throughout.

BRIEF DESCRIPTION OF THE DRAWINGS

FIG. 2 is a side view illustrating the device, including the integral means for illumination, diaphragm-like means for speaking and means for producing breathable air;

FIG. 3 is a front elevational view of the device showing a canister attachment;

DESCRIPTION OF THE PREFERRED EMBODIMENT

Figure 1:
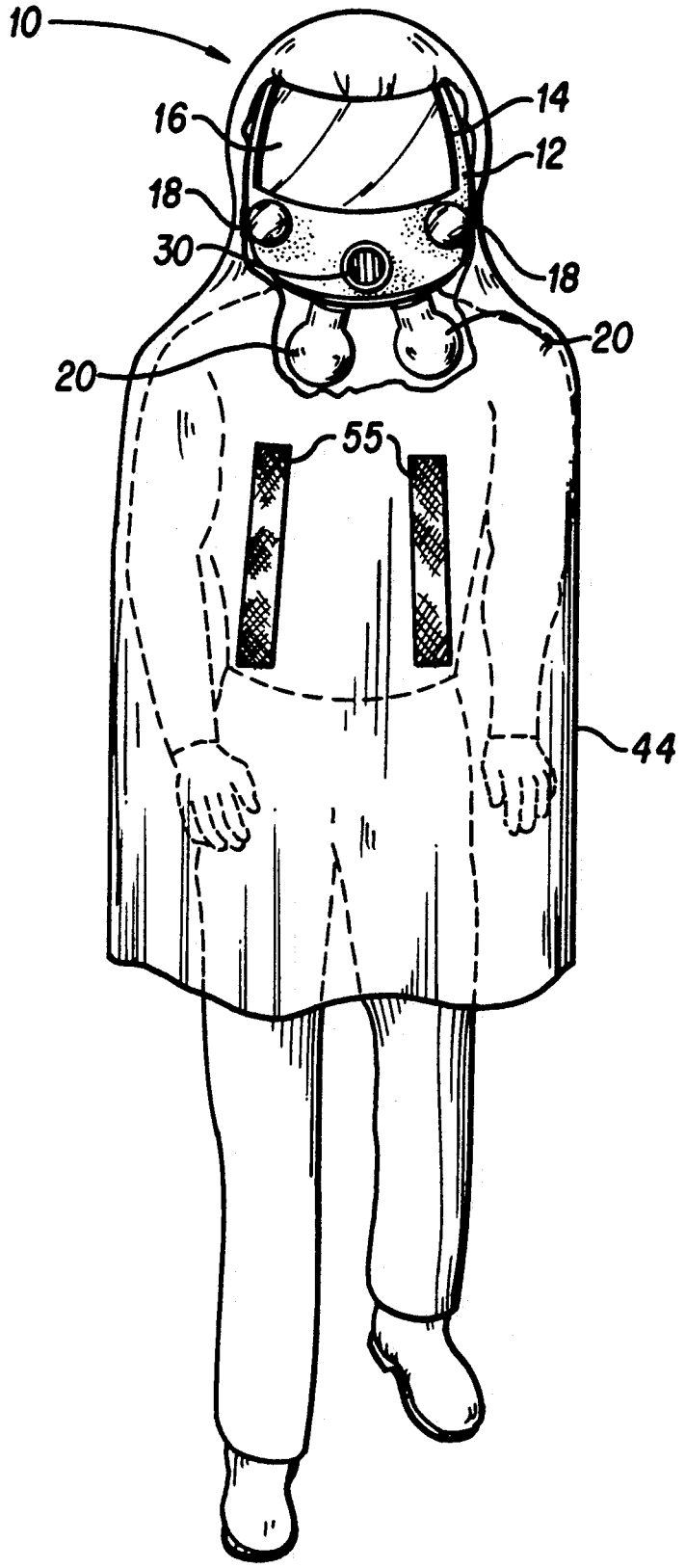
FIG. 1 is an elevational view showing the device of the present invention in use.

Referring now to the drawings, FIGS. 1 and 2 illustrate the rescue helmet 10, including base helmet member 12 circumferentially adapted to fit over the head of a user, and having a cutaway area 14 removed so as to provide a housing or containment for a face shield 16.

Face shield 16 is mounted within a lowermost mounting means 17 that has a cross-sectional configuration substantially circular so that the wearer is presented with a full view, side-to-side. Face shield 16 is rigidly affixed within lowermost mounting means 17 which has a plurality of recessed and molded areas 27 disposed therein for the accommodation of a variety of functional elements. These functional elements include the means for illumination 18, and means for adaptation 24 to an air-producing canister 20. The illumination means 18 may be provided with a pair of long-lasting lithium-powered lights on either side of the face shield 16.

The air-producing canister 20 allows breathable air to enter the base helmet member 12 at a predetermined rate. The air-producing producing canister thereby pressurizes the air in the base helmet member 12. This positive air pressure allows for exhaust of the user's exhaled breath at a predetermined rate. Furthermore, the positive pressurization will prevent external gases, smoke or fumes from entering the base helmet member 12.

In the preferred embodiment of the invention, base helmet member 12 is provided with two mounting means 27. This allow the user to first activate one air-producing canister 20 and then activate the secondary air-producing canister 20. Therefore, the provision for two air-producing canisters allows extended use of the invention.

Figure 8:
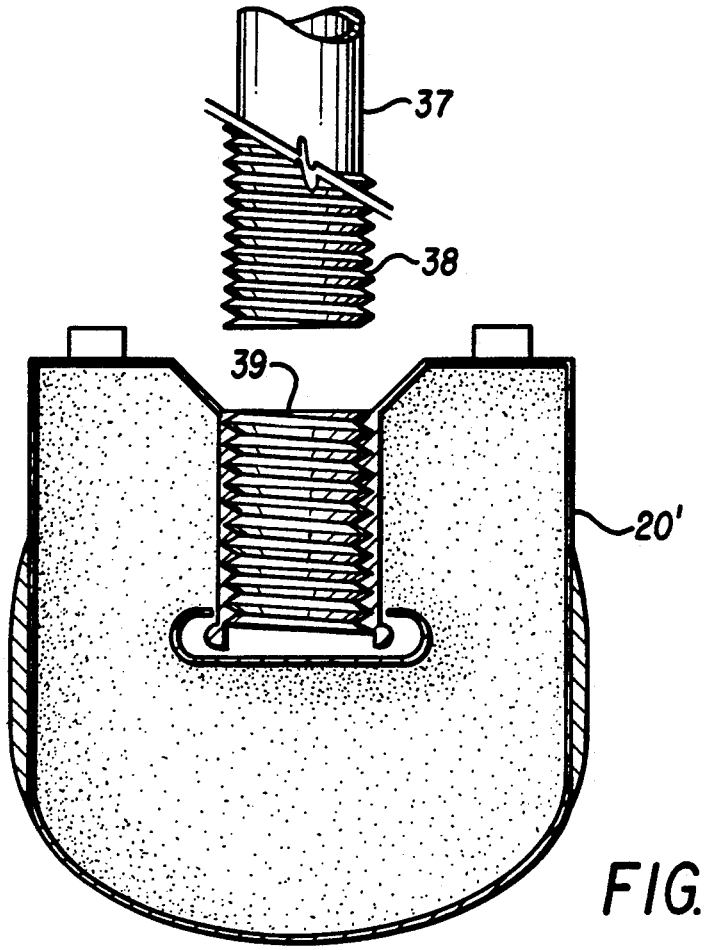
FIG. 8 is an elevational view of an air-producing member and an alternative adapter element for coupling the chemical air producer or air canister to the helmet.

The air-producing canister 20 may be provided by two specific constructions. In one embodiment of the present invention, as shown in FIG. 8 at 20', the air-producing canister comprises a canister containing a chemical agent which has the property of reacting with exhalation to produce breathable oxygen. One known type of canister that is appropriate for this purpose is a canister having a copper-plated steel shell containing a potassium super oxide candle. When air is needed, the operator pulls a cord that actuates an igniter. The igniter serves as a starter for a reaction that produces oxygen for breathing.

Figure 9:
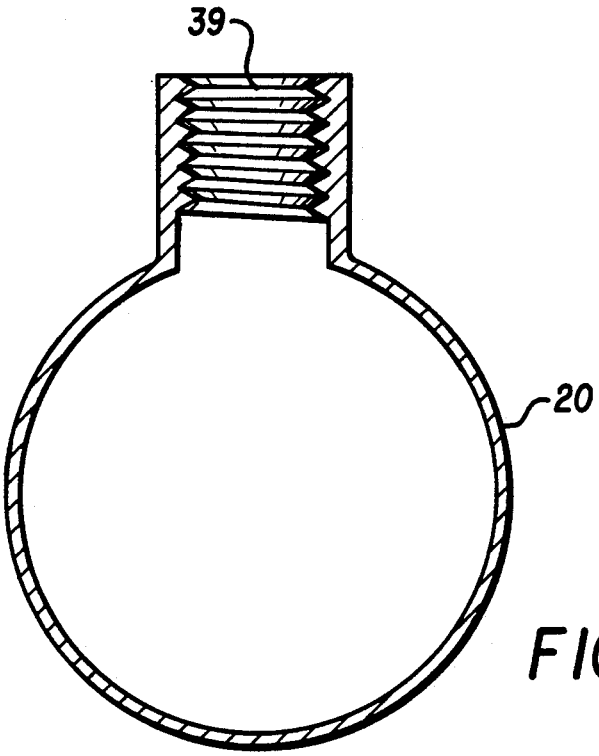
FIG. 9 is an elevational view of an alternative air-producing member with an alternative adapter element.

In another embodiment, as shown in FIG. 9, the air-producing canister 20 may be provided by a container of pressurized air.

Figure 6:
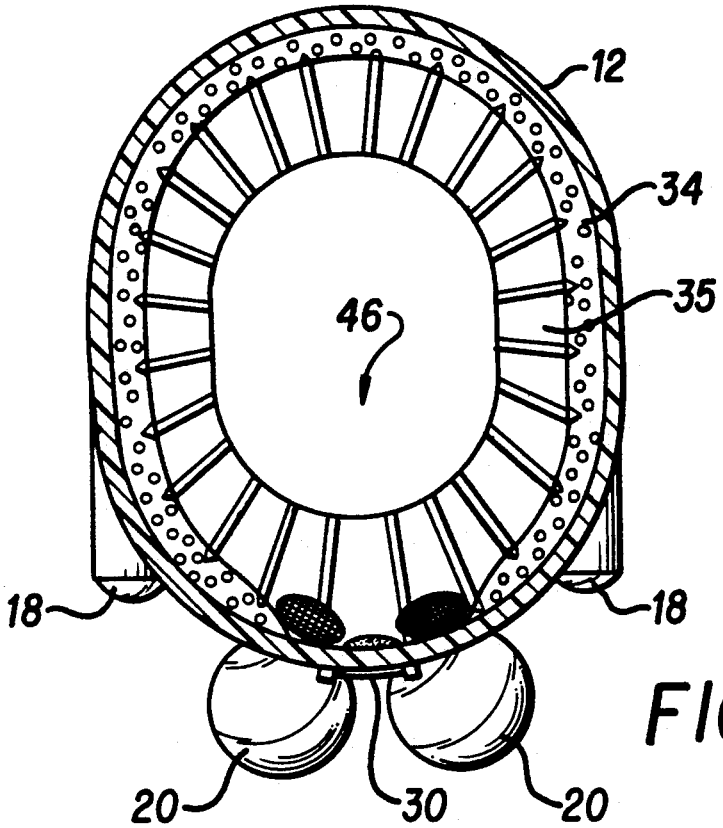
FIG. 6 is a top, or plan, sectional view taken through line 6—6 of FIG. 3.
Figure 7:
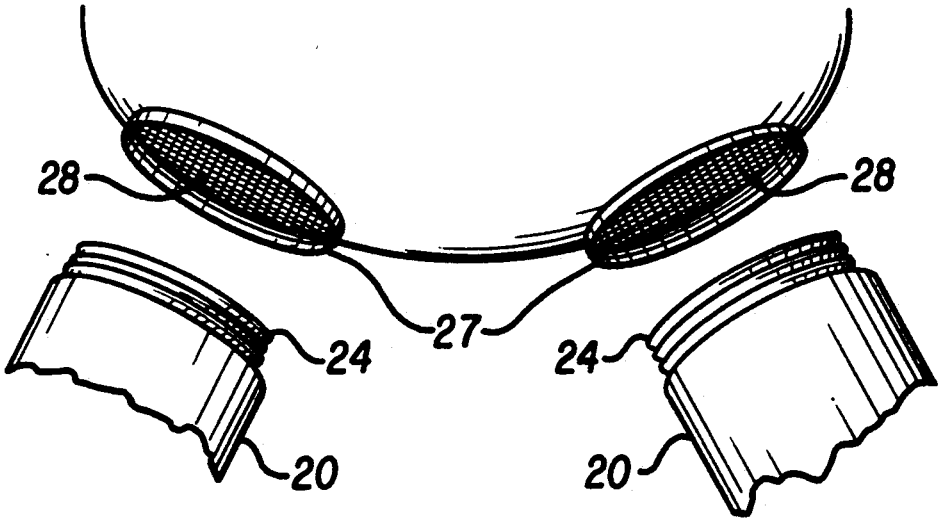
FIG. 7 is a perspective view illustrating typical attachment means of the device to a chemical air converter or air canister unit.

As seen in FIGS. 6 and 7, tubular adapter 24 connects the air-producing canister 20 to base helmet member 12 by affixing each member respectively to the recessed and molded areas 27 on the lowermost mounting means 17. Tubular adapter 24 has, preferably, a threaded type connector as illustrated in FIG. 7, having threaded means deployed for removably attaching the air-producing canister 20. As air-producing canister 20 is threaded into tubular adapter 24 it punctures or tears protective cover 28, thus allowing an exchange of breathable air from the air-producing canister 20 to the user of the rescue helmet.

An alternative adapter, shown in FIGS. 8 and 9, shows a tubular adapter 37 with threads 28 on the end, connected to the lowermost mounting means (not shown). The canister 20 has internal threads 39 that mate with threads 38 to mount canister 20 onto the tubular adapter 37 and the lowermost mounting means 17 of base helmet member 12.

Figure 4:
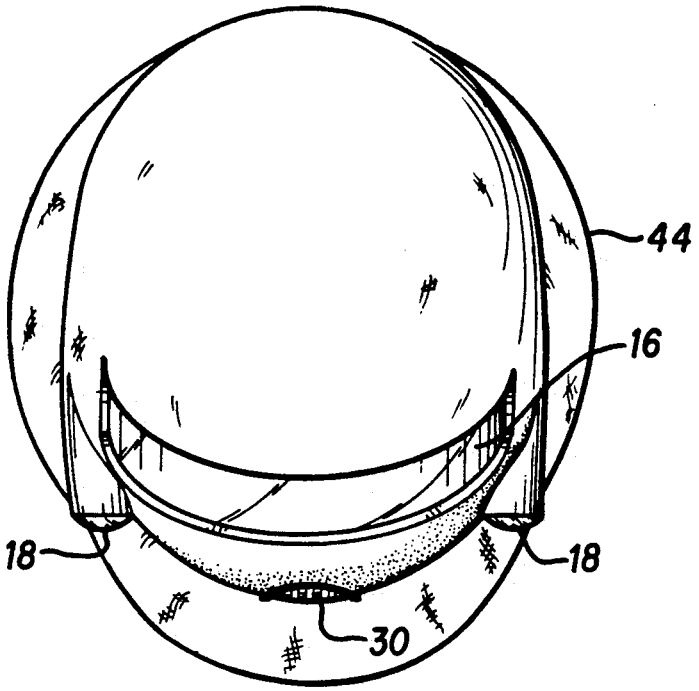
FIG. 4 is a plan view of the rescue helmet apparatus.
Figure 5:
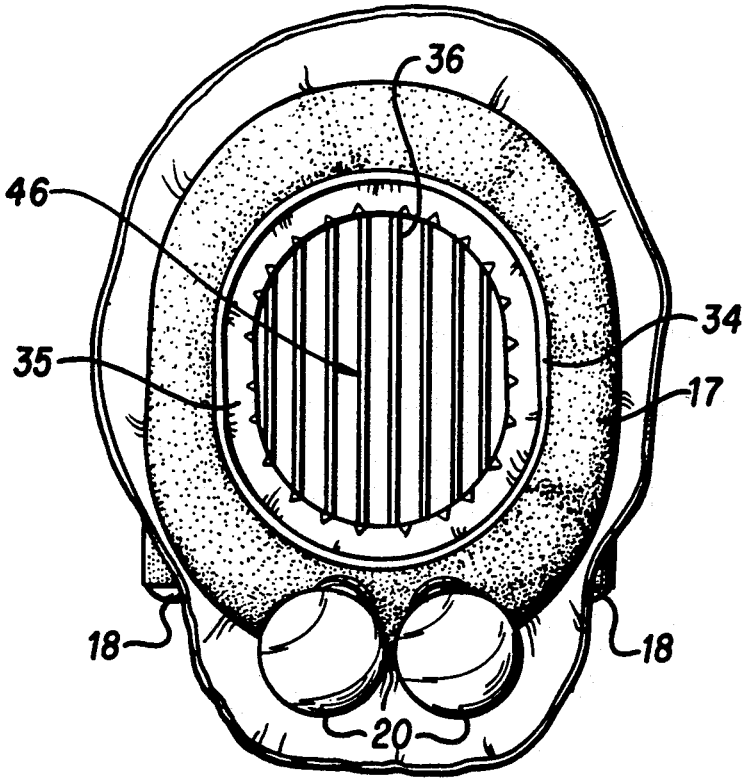
FIG. 5 is a bottom view into the interior of the helmet apparatus.

Referring now to FIGS. 2 through 4, speaker diaphragm 30 is equally recessed into lowermost mounting means 17. Diaphragm 30 is deployed proximate the mouth of a user of the rescue helmet.

Illumination means 18 is fastened into lowermost mounting means 17 substantially as shown in FIG. 3, and secured by resiliently snapping a light module into a recess (not shown) adapted to receive a light module within lowermost mounting means 17. The illumination means 18 may be provided by any suitable lighting device, although a long-lasting lithium-powered light is preferred.

Base helmet member 12 has a plurality of cushion means 34 and 36 affixed to the interior of said base helmet member 12 that function to absorb impacts upon the device. Cushion means 34 and 36 consisting of padded strips are interiorally deployed, cushion means 34 being positioned peripheral to the neck and cushion means 36 being positioned longitudinally at substantially regular intervals proximate the head of a wearer, and act cooperatively with an elastic closure strip 35 that is peripheral to a neck orifice 46. The padding 34 and the elastic closure strip 35 act cooperatively to thus seal the skin or head of the wearer, so as to prevent noxious gases from seeping upward int eh base helmet member 12 and thence into the airspace created between the interior of the face shield 16 and the face of the wearer of the rescue helmet.

Referring again to FIGS. 2 through 4, upper planar edge 42 of lowermost mounting means 17 has a lightweight reflective cape 44 that maybe constructed of any suitable material, as may be base helmet member 12 and lowermost mounting means 17, foil aluminum being one such material for which cape 44 could be made.

Reflective cape 44 fits into the upper portion of lowermost mounting means 17 and extends upwardly over the chest and back of the user, over the shoulders and waist of the user, thus forming a cape-like structure. The reflective cape 44 may be entirely reflective, or may feature strips or reflective material 55 as shown. The length of the cape is substantially sufficient to cover the shoulders and torso of the user.

It will be apparent from the foregoing that the objects and advantages of the invention have been realized and, further, since numerous small changes will be obvious to those skilled in the art, the foregoing is illustrative of the principles of the invention only. All equivalents thereof fall within the scope of the invention, the limits thereto being limited only by the following claims.

I claim:

1. A rescue helmet apparatus, comprising:

a base helmet member having a neck orifice at a lower portion of said helmet member;

a transparent face shield member rigidly affixed and integral with said base helmet member;

said neck orifice of said base helmet member having elastic means for sealing the interior of said base helmet member;

said base helmet member having a lowermost mounting means integral therewith that has receptacle means for an illumination means, said illumination mean being incorporated therein, said illumination means being disposed proximate to a means for providing breathable air;

said means for providing breathable air detachably mounted to said lowermost mounting means whereby a user inhales clean air and is protected from the effects of oxygen-depleted air, smoke or noxious fumes and is further protected from heat and exposure to flame;

a reflective cape overlying said base helmet member, said reflective cape substantially enfolding the shoulders, back and chest of a wearer whereby heat is reflected from said apparatus to thus protect the head, back, chest and shoulders of a wearer of the device; and said base helmet member substantially rounded and having cushion means interiorly disposed along said neck orifice and longitudinally about the interior of said base helmet member at substantially even intervals.

2. A rescue helmet apparatus as recited in claim 1, wherein said means for providing breathable air comprises a pressurized air canister having threaded means disposed thereon whereby said pressurized air canister can be removably attached to said lowermost mounting means.

3. A rescue helmet apparatus as recited in claim 1, wherein said means for providing breathable air comprises a canister containing therein any suitable chemically reactive agent that reacts with exhaled air to produce breathable oxygen, thereby allowing the air to be recycled for continued breathing, said canister having threaded means disposed thereon whereby said canister can be removably attached to said lowermost mounting means.

4. A rescue helmet apparatus as recited in claim 1, wherein said elastic means is a pliable layer defining a closure strip, said closure strip cooperates with said cushion means to thereby define a seal between said base helmet member and a wearer of the device.

5. A rescue helmet apparatus as recited in claim 1, wherein said illumination means is disposed on either side of said face shield member.

* * * * *